US009181681B2

(12) United States Patent
Okazaki et al.

(10) Patent No.: US 9,181,681 B2
(45) Date of Patent: Nov. 10, 2015

(54) WORKING VEHICLE

(75) Inventors: Kohei Okazaki, Fukuoka (JP); Nagahiro Ogata, Fukuoka (JP); Mitsuhiro Takahashi, Fukuoka (JP)

(73) Assignee: YANMAR CO., LTD. (JP)

( * ) Notice: Subject to any disclaimer, the term of this patent is extended or adjusted under 35 U.S.C. 154(b) by 159 days.

(21) Appl. No.: 13/882,047

(22) PCT Filed: Oct. 20, 2011

(86) PCT No.: PCT/JP2011/074193
§ 371 (c)(1),
(2), (4) Date: Apr. 26, 2013

(87) PCT Pub. No.: WO2012/056993
PCT Pub. Date: May 3, 2012

(65) Prior Publication Data

US 2013/0218425 A1 Aug. 22, 2013

(30) Foreign Application Priority Data

Oct. 27, 2010 (JP) ..... 2010-241554

(51) Int. Cl.
*E02F 9/20* (2006.01)
*E02F 3/96* (2006.01)
*E02F 9/22* (2006.01)
*E02F 9/26* (2006.01)

(52) U.S. Cl.
CPC ..... *E02F 9/2025* (2013.01); *E02F 3/963* (2013.01); *E02F 9/2228* (2013.01); *E02F 9/264* (2013.01)

(58) Field of Classification Search
CPC ..... B62D 5/06; E01H 5/00; F04B 49/00; G08B 21/00
See application file for complete search history.

(56) References Cited

U.S. PATENT DOCUMENTS 4,702,335 A * 10/1987 Cage et al. ..... 180/423
2002/0083825 A1 7/2002 Kusuyama
(Continued)

FOREIGN PATENT DOCUMENTS

CN 1362586 A 8/2002
JP 2002-201675 A 7/2002
(Continued)

OTHER PUBLICATIONS

Korean Office Action corresponding to Application No. 10-2013-7013191, Mailed: Jul. 11, 2014, with English translation.
(Continued)

*Primary Examiner* — Helal A Algahaim
*Assistant Examiner* — Michael Fouche
(74) *Attorney, Agent, or Firm* — Cantor Colburn LLP

(57) ABSTRACT

The working vehicle may include a working apparatus in which an attachment is attachably mounted, a flow rate limitation setting means to set the maximum flow rate of hydraulic oil, an engine revolution sensor, a cam plate angle sensor, a valve opening degree sensor to measure a present flow rate of the hydraulic oil, a switching valve to switch between a single acting type and a double acting type, a display, a main controller to connect the flow rate limitation setting means, the engine revolution sensor, the cam plate angle sensor, the valve opening degree sensor, the switching valve, and the display apparatus. The maximum flow rate and the present flow rate, which are set by the flow rate limitation setting means, may be simultaneously displayed on the display apparatus.

4 Claims, 7 Drawing Sheets

(56) References Cited

U.S. PATENT DOCUMENTS

| | | | | |
|---|---|---|---|---|
| 2008/0201994 | A1* | 8/2008 | Crago | 37/197 |
| 2009/0238696 | A1* | 9/2009 | Satake et al. | 417/34 |
| 2009/0243831 | A1* | 10/2009 | Miura et al. | 340/450 |

FOREIGN PATENT DOCUMENTS

| | | | |
|---|---|---|---|
| JP | 2004-116103 | A | 4/2004 |
| JP | 2007092763 | A | 4/2007 |
| JP | 2007-162866 | A | 6/2007 |
| KR | 10-0832311 | B1 | 5/2008 |
| KR | 10-2009-0023801 | A | 3/2009 |

OTHER PUBLICATIONS

Second Office Action corresponding to Chinese Application No. 201180051419.4; Date of Issue: Nov. 15, 2014, with English translation.

International Search Report for International application No. PCT/JP2011/074193, mailed Jan. 24, 2012, with English translation.

* cited by examiner (a)

(b)

(a)

(b)

WORKING VEHICLE

CROSS REFERENCE TO RELATED APPLICATIONS

This is the U.S. national stage of application No. PCT/JP2011/074193, filed on 20 Oct. 2011. Priority under 35 U.S.C. §119(a) and 35 U.S.C. §365(*b*) is claimed from Japanese Application No. 2010-241554, filed 27 Oct. 2010, the disclosure of which is also incorporated herein by reference.

TECHNICAL FIELD

The present invention relates to a working vehicle including a plurality of hydraulic actuators, and more particularly, relates to a working machine in which a display portion is provided in the vicinity of a driver seat.

BACKGROUND ART

Conventionally, working vehicles are constituted such that a plurality of hydraulic actuators are operated by a plurality of operating lever apparatuses, thereby allowing a working apparatus included in the working vehicle to carry out a desired operation or work. The working apparatus is constituted such that attachments can be replaced that include a tilting bucket, a breaker, a clamshell, an auger, a grapple, and a bush cutter, depending on the purposes of work. Herein, when each attachment is replaced, the maximum established flow rate of hydraulic oil flowing in the hydraulic actuator is changed. There has been known a working vehicle wherein a display portion such as a meter panel is provided in the close vicinity of a driver seat in order to inform an operator of the flow rate to be set, and the maximum flow rate of the hydraulic oil flowing in the hydraulic actuator is displayed on the display portion.

RELATED ART DOCUMENT

Patent Document

[Patent Document 1] Japanese Unexamined Patent Application Publication No. 2007-92763.

DISCLOSURE OF THE INVENTION

Problems to be Solved by the Invention

However, even when the maximum flow rate of the hydraulic oil is displayed on the display portion, the flow rate of the hydraulic oil in the course of actual operations is not displayed, which fails to notify an operator of the change in the flow rate of the hydraulic oil in the course of actual operations in real time. That is, when the maximum flow rate is displayed in the conventional way, it has been impossible for the operator to recognize how much load should be applied in order not to exceed the maximum flow rate.

Accordingly, the present invention has been made to solve the above-described problems. It is an object of the present invention to provide a working vehicle that can verify the maximum flow rate of the hydraulic oil flowing through a hydraulic actuator and the flow rate of the hydraulic oil in the course of actual operations.

Means of Solving the Problems

The problems to be solved by the present invention have been described hereinabove, and subsequently, the means of solving the problems will be described below.

That is, according to claim 1 of the present invention, a working vehicle may include a working apparatus in which an attachment operated by a hydraulic actuator is attachably mounted, a flow rate limitation setting means configured to set a maximum flow rate of hydraulic oil that is supplied and discharged with respect to the hydraulic actuator, a measuring means configured to measure a present flow rate of the hydraulic oil, a switching setting means configured to switch between a single acting type and a double acting type in accordance with a type of the hydraulic actuator, a display means configured to display the flow rate of the hydraulic oil and whether the hydraulic actuator is made up of any of the single acting type and the double acting type, a main controlling apparatus configured to connect the flow rate limitation setting means, the measuring means, the switching setting means and the display means, and wherein the maximum flow rate which is set by the flow rate limitation setting means and the present flow rate are simultaneously displayed on the display means.

According to claim 2 of the present invention, the display of the maximum flow rate and the display of the present flow rate may be switchably displayed on the display means.

According to claim 3 of the present invention, the display of the maximum flow rate and the display of the present flow rate may be displayed in numerical values on the display means.

According to claim 4 of the present invention, the display of the maximum flow rate and the display of the present flow rate may be displayed by figures on the display means.

Effects of the Invention

The embodiments of the present invention provide the following advantageous effects.

According to claim 1 of the present invention, the maximum flow rate of the hydraulic oil and the flow rate of the hydraulic oil that actually flows can simultaneously be verified. Also, whether the attachment hydraulic actuator is of the single acting type or of the double acting type can be verified.

According to claim 2 of the present invention, the operator can select and verify the information that the operator needs to know, out of the maximum flow rate and the present flow rate.

According to claim 3 of the present invention, the maximum flow rate of the hydraulic oil and the flow rate of the hydraulic oil that actually flows can be verified by the numerical values one time.

According to claim 4 of the present invention, the maximum flow rate of the hydraulic oil and the flow rate of the hydraulic oil that actually flows can be verified by the figures one time.

BEST MODE FOR CARRYING OUT THE INVENTION

Figure 1:
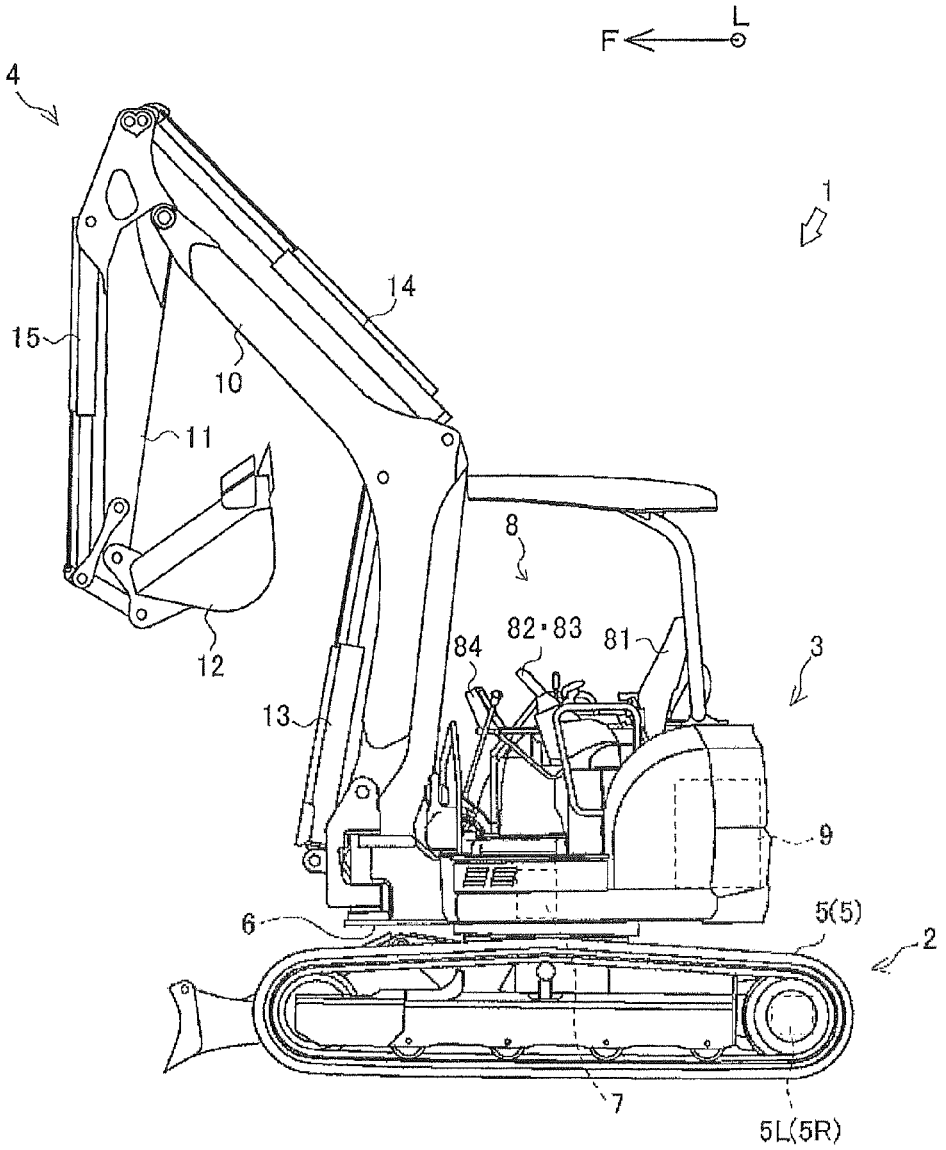
FIG. 1 is a side view illustrating the entire configuration of a working vehicle according to a first embodiment of the present invention.

First, a backhoe 1, which is a working vehicle according to a first embodiment of the present invention, will be described referring to FIGS. 1 to 3. In the embodiment of the present invention, the backhoe 1 is described as the working vehicle according to the first embodiment of the present invention, but the working vehicle is not limited to this and may be applied as other working vehicles such as an agricultural equipment vehicle, a construction equipment vehicle, and an industrial vehicle.

In the description below, it is defined that an arrow F direction is the forward direction of the backhoe 1, and an arrow L direction is the left direction of the backhoe 1, so as to represent the forward-and-backward, left-and-right, and up-and-down directions.

The backhoe 1 mainly includes a travelling apparatus 2, a rotation apparatus 3, and a working apparatus 4.

The travelling apparatus 2 mainly includes a symmetrical pair of crawlers 5, a left travelling hydraulic motor 5L, which is a hydraulic actuator, and a right travelling hydraulic motor 5R, which is the hydraulic actuator.

Regarding the travelling apparatus 2, the left travelling hydraulic motor 5L drives the crawler 5 on the left side of the body, and the right travelling hydraulic motor 5R drives the crawler 5 on the right side of the body, thereby allowing the backhoe 1 to advance forward and backward or changing the advancing direction of the backhoe 1.

The rotation apparatus 3 mainly includes a rotation platform 6, a rotation motor 7, which is the hydraulic actuator, an operating portion 8, and an engine 9.

The rotation platform 6 serves as the main structure of the rotation apparatus 3. The rotation platform 6 is disposed above the travelling apparatus 2 and rotatably supported on the travelling apparatus 2. The rotation apparatus 3 drives the rotation motor 7, thereby rotating the rotation platform 6 with respect to the travelling apparatus 2. Also, a hydraulic oil tank not shown is disposed on the rotation platform 6, in addition to the operating portion 8 including various operating devices, the engine 9 that serves as a power source, and the like.

The working apparatus 4 mainly includes a boom 10, an arm 11, a bucket 12, a boom cylinder 13 that is the hydraulic actuator, an arm cylinder 14 that is the hydraulic actuator, and a bucket cylinder 15A that is an attachment hydraulic actuator 15.

One end portion of the boom 10 is pivotably supported by the anterior portion of the rotation platform 6 and rotated by the boom cylinder 13 that retractably drives. More particularly, when the boom cylinder 13 is extended, the boom 10 is upwardly rotated. When the boom cylinder 13 is retracted, the boom 10 is downwardly rotated.

One end portion of the arm 11 is pivotably supported by the other end portion of the boom 10 and rotated by the arm cylinder 14 that retractably drives. More particularly, when the arm cylinder 14 is extended, the arm 11 is rotated downwardly (the direction that the other end side of the arm 11 is brought into close proximity to the boom 10). When the arm cylinder 14 is retracted, the arm 11 is upwardly rotated (the direction that the other end side of the arm 11 is detached from the boom 10).

The bucket 12 is one example of the attachments, and one end portion of the bucket 12 is supported by the other end portion of the arm 11 and rotated by the bucket cylinder 15A that is a sort of attachment hydraulic actuator 15, which retractably drives. More particularly, when the bucket cylinder 15A is extended, the bucket 12 is rotated downwardly (the direction that the other end side of the bucket 12 is brought into close proximity to the arm 11). When the bucket cylinder 15A is retracted, the bucket 12 is rotated upwardly (the direction that the other end side of the bucket 12 is detached from the arm 11).

The boom cylinder 13, the arm cylinder 14, and the bucket cylinder 15A are operated by means of the hydraulic oil. The hydraulic oil in the hydraulic oil tank not shown and provided on the rotation platform 6 is forwarded to the boom cylinder 13, the arm cylinder 14, and the bucket cylinder 15A that is a sort of attachment hydraulic actuator 15, via a control valve 41 (see FIG. 4), thereby operating the boom 10, the arm cylinder 14, and the bucket cylinder 15A.

The attachments include a tilting bucket, a breaker, a clamshell, an auger, a grapple, a bush cutter, and the like, which can be mounted in place of the bucket 12. The attachment hydraulic actuator 15 such as a hydraulic cylinder and a hydraulic motor, which move attachments, is constituted by any of a single acting type and a double acting type in accordance with a type of attachments. The attachment hydraulic actuator 15 of the single acting type includes one hydraulic oil path that supplies pressure oil and is a hydraulic cylinder that drives a piston in one direction and restrains the movement of the piton in the reverse direction or operates the piston with an elastic member and the like, or is a hydraulic motor that drivingly rotates the piston only in one direction. Also, the attachment hydraulic actuator 15 of double acting type includes two hydraulic oil paths that supply pressure oil and is a hydraulic cylinder that carries out an extending operation and a retracting operation so as to supply the pressure oil to chambers disposed on both sides of the piston or is a hydraulic motor that enables normal rotation or reverse rotation. The bucket cylinder 15A is the attachment hydraulic actuator 15 of double acting type. The selection between the single acting type and the double acting type is carried out by a switching valve 51 (see FIG. 4), which is a switching setting means.

Figure 4:
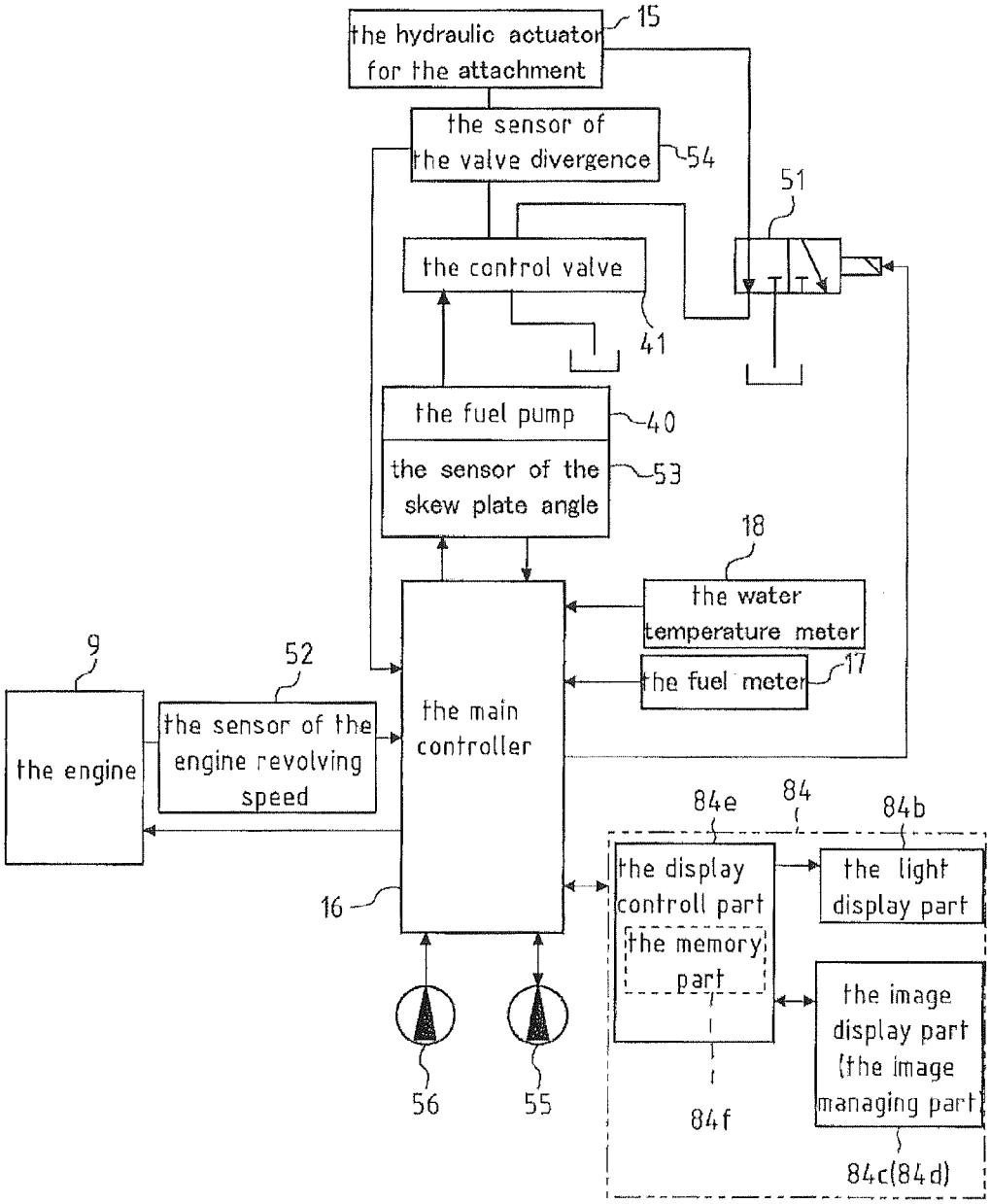
FIG. 4 is a block diagram illustrating controlling configuration according to the first embodiment of the present invention.

Also, the backhoe 1 includes a hydraulic pump 40 (see FIG. 4). The hydraulic pump 40 is driven by the engine 9 and discharges the hydraulic oil. The hydraulic pump 40 is a pump of a variable capacity type, wherein the amount of discharge is constituted to be changeable by changing the cam plate angle of a movable cam plate not shown. Also, as is illustrated in FIG. 4, a switching valve 51 to move the spool of a directional switching valve (valve) is provided in the hydraulic oil path connected to the hydraulic pump 40.

Figure 2:
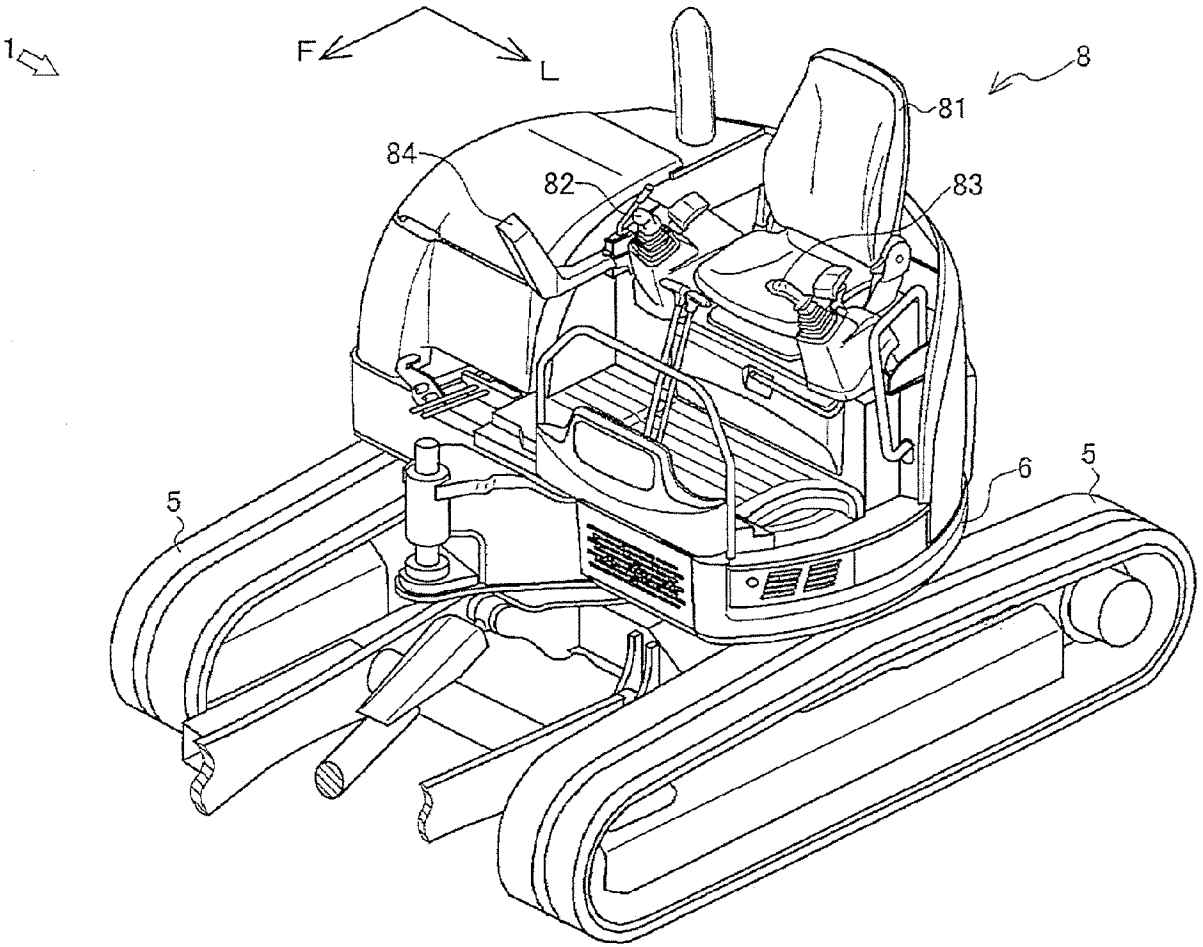
FIG. 2 is a perspective view illustrating the configuration of an operating portion of the working vehicle according to the first embodiment of the present invention.

As is illustrated in FIG. 2, an operating seat 81 is provided approximately in the center of the operating portion 8, and a right-side operating lever 82 and a left-side operating lever 83 are arranged on both left and right sides of the operating seat 81. The control valve 41 is operably constituted by operating each operating lever apparatus. The rotation motor 7, the boom cylinder 13, the arm cylinder 14, and the bucket cylinder 15A are operated by manipulating the control valve 41. A display apparatus 84 that is a display means is provided on one of the left and right sides of the operating seat 81 (on the right side in the embodiment). The display apparatus 84 is arranged in such a manner that a display portion is disposed opposite to an operator seated at the operating seat 81. Also, a throttle adjusting device (throttle lever or dial), not shown, that changes a throttle opening degree of the engine 9 is provided in the operating portion 8. The operator can change the output of the engine 9 by operating the throttle adjusting device.

Figure 3:
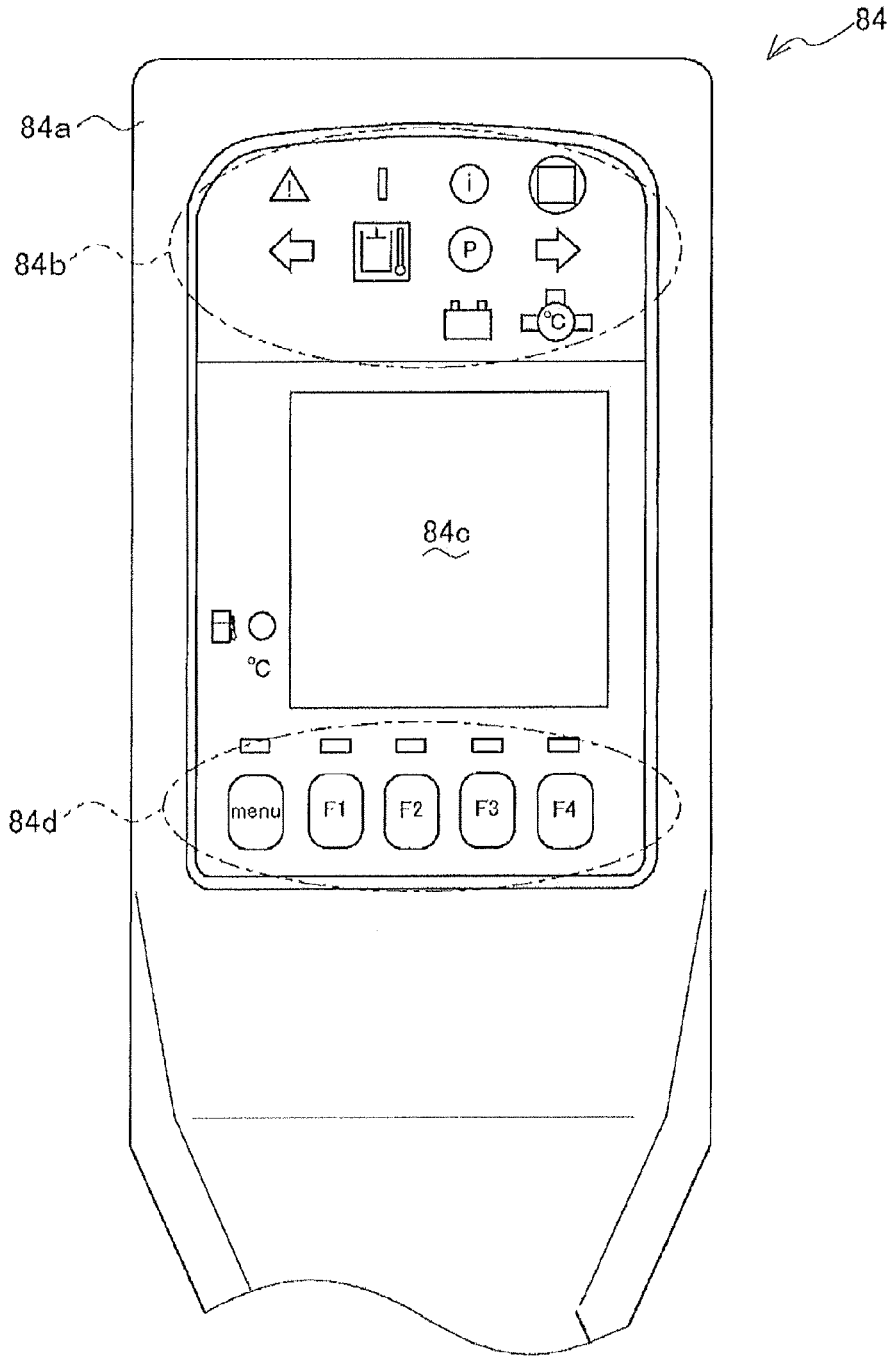
FIG. 3 is a front view illustrating the configuration of a display apparatus of the working vehicle according to the first embodiment of the present invention.

As is illustrated in FIGS. 2 and 3, the display apparatus 84 includes a frame body 84*a*, a light display part 84*b*, an image display part 84*c*, an image screen operating part 84*d*, a display control part 84*e* (see FIG. 4).

The frame body 84*a* is formed in a box form having an approximately L-shape when viewed from the side thereof. The frame body 84*a* whose end portion is directed to the upper side is arranged laterally on the right side of the operating seat 81 in such a manner that the short side portion thereof is disposed opposite to the operating seat 81.

The light display part 84*b* is provided in an upper side portion of the short side portion of the frame body 84*a*. The operational states of the backhoe 1 and a plurality of figures that represent the presence and absence of a warning are displayed on the light display part 84*b* in which LEDs as a lighting member are arranged to display each figure. On the light display part 84*b*, only a specific figure is lighted by lighting the LED corresponding to a predetermined condition. Thus, the light display part 84*b* is constituted in such a manner as to transmit information to the operator. In the embodiment of the present invention, the light display part 84*b* lights the LEDs for display, but is not limited to this. A light source whose light can be controlled may be applied for the light display part 84*b*.

The image display part 84*c* is disposed at a short side portion of the frame body 84*a* and at the down side portion of the light display part 84*b*. The image display part 84*c* is constituted by a liquid crystal screen to display information. The image display part 84*c* switches displays on the liquid crystal screen in accordance with respective operating modes based on the operation of the image screen operating part 84*d* described later, thereby verifying the operating states of the backhoe 1. Thus, the image display part 84*c* is constituted in such a manner as to transmit the information to the operator. In the embodiment of the present invention, the image display part 84*c* is displayed by the liquid crystal screen, but is not limited to this. However, one that can arbitrarily display plural pieces of information can be applied.

The image screen operating part 84*d* is disposed at a short side portion of the frame body 84*a* and at the down side portion of the image display part 84*c*. The image screen operating part 84*d* includes a plurality of operating buttons. The image screen operating part 84*d* is constituted in such a manner as to select image screens displayed on the image display part 84*c* by the operating the operating buttons.

The display control part 84*e* controls the light display part 84*b* and the image display part 84*c*. The display control part 84*e* is disposed in the frame body 84*a* in close proximity to the light display part 84*b* and the image display part 84*c* or integrally constituted with a main controller 16 described later (see FIG. 4).

Next, the main controller 16 included in the backhoe 1 according to the present invention and the display control part 84*e* included in the display apparatus 84 will specifically be described referring to FIG. 4.

As is illustrated in FIG. 4, the main controller 16 controls the engine 9, the hydraulic apparatuses and the like. The main controller 16 stores various programs to control the engine 9, the hydraulic apparatuses and the like. Also, the main controller 16 can carry out predetermined arithmetic operations in accordance with these programs and store the results of the arithmetic operations and the like.

The main controller 16 may substantively be constituted by a CPU, a ROM, a RAM, HDD, and the like, which are connected to each other via a bus, or may be constituted by one-chip LSI and the like.

The main controller 16 is connected to an engine revolution sensor 52 and a fuel injection apparatus, which are provided in the engine 9, thereby controlling the engine 9.

The main controller 16 is connected to a fuel meter 17, thereby obtaining fuel residual quantity F1, detected by the fuel meter 17, in a fuel tank not shown.

The main controller 16 is connected to a water temperature meter 18, thereby obtaining a coolant temperature T, detected by water temperature meter 18, in the engine 9.

The main controller 16 is connected to a cam plate angle sensor 53 and a pressure sensor not shown, which are provided in the hydraulic pump 40, thereby controlling the angle of a movable cam plate of the hydraulic pump 40 and the like.

The main controller 16 is connected to a valve opening degree sensor 54 provided in the control valve 41 so as to detect a spool stroke of the control valve 41 or detect pilot pressure that operates the spool, thereby obtaining the opening degree of the control valve 41. When an electromagnetic proportional valve is used, an instruction flow rate can be obtained based on a controlled current value.

The main controller 16 is connected to the switching valve 51, which moves the spool of the directional switching valve (valve), thereby switching the direction that the hydraulic oil flows.

The main controller 16 is connected to a flow rate limitation setting means 55. For example, when the breaker is used, the maximum flow rate Qmax of the hydraulic oil that is supplied and discharged with respect to the attachment hydraulic actuator 15 in accordance with the attachment can be set.

The flow rate limitation setting means 55 utilizes a control map stored in the main controller 16 in advance, thereby variably setting the maximum flow rate Qmax of the hydraulic oil that is supplied and discharged with respect to the breaker.

The main controller 16 is connected to a switching switch 56. When the switching switch 56 is operated, switching information, which determines whether the switching valve is put into any state of "single acting" and "double acting", is transmitted to the main controller 16.

The main controller 16 utilizes engine revolution information transmitted from the engine revolution sensor 52, cam plate angle information inputted from the cam plate angle sensor 53, and valve opening degree information inputted from the valve opening degree sensor 54, thereby calculating the flow rate q of the present hydraulic oil.

The main controller 16 is connected to the display control part 84*e* of the display apparatus 84 and transmits signals with regards to warning and error information, the fuel residual quantity F1, the coolant temperature T, status information on the switching valve 51, the maximum flow rate Qmax of the hydraulic oil, and the flow rate q of the present hydraulic oil, to the display control part 84*e*, whereby a predetermined display is carried out on the light display part 84*b* or the image display part 84*c* based on the control of the display control part 84*e*.

Next, the display control part 84*e* included in the display apparatus 84 will specifically be described.

The display control part 84*e* controls the display apparatus 84. The display control part 84*e* stores various programs to control the display apparatus 84. Also, the display control part 84*e* can carry out predetermined arithmetic operations in accordance with these programs and includes a storing portion 84*f* to store the results of the arithmetic operations and the like.

The display control part 84*e* may substantively be constituted by the CPU, the ROM, the RAM, the HDD, and the like, which are connected to each other via the bus, or may be constituted by one-chip LSI and the like. Also, the display control part 84*e* is separately constituted with respect to the main controller 16 described later in the embodiment of the present invention, but is not limited to this, and the display control part 84*e* may integrally be constituted with the main controller 16.

The display control part 84*e* is connected to the light display part 84*b*, thereby transmitting the control signal to the light display part 84*b*. That is, the display control part 84*e* can light predetermined LEDs on the light display part 84*b* by transmitting the control signal to the light display part 84*b* of the display apparatus 84.

The display control part 84*e* is connected to the main controller 16, thereby obtaining information such as the fuel residual quantity F1, the coolant temperature T, the warning and error information, the status information on the switching valve, the maximum flow rate Qmax of the hydraulic oil, and the flow rate q of the present hydraulic oil, from the main controller 16. Also, the display control part 84*e* is connected to the image display part 84*c* and the image screen operating part 84*d*, thereby transmitting the control signal to the image display part 84*c* and obtaining an input signal from the image screen operating part 84*d*. That is, the display control part 84*e* can display information on the operating states of the backhoe 1 on the image display part 84*c* by transmitting the control signal to the image display part 84*c*.

Next, information displayed on the image display part 84*c* according to the display control part 84*e* of the display apparatus 84 will be described referring to FIGS. 5 and 6.

Figure 5:
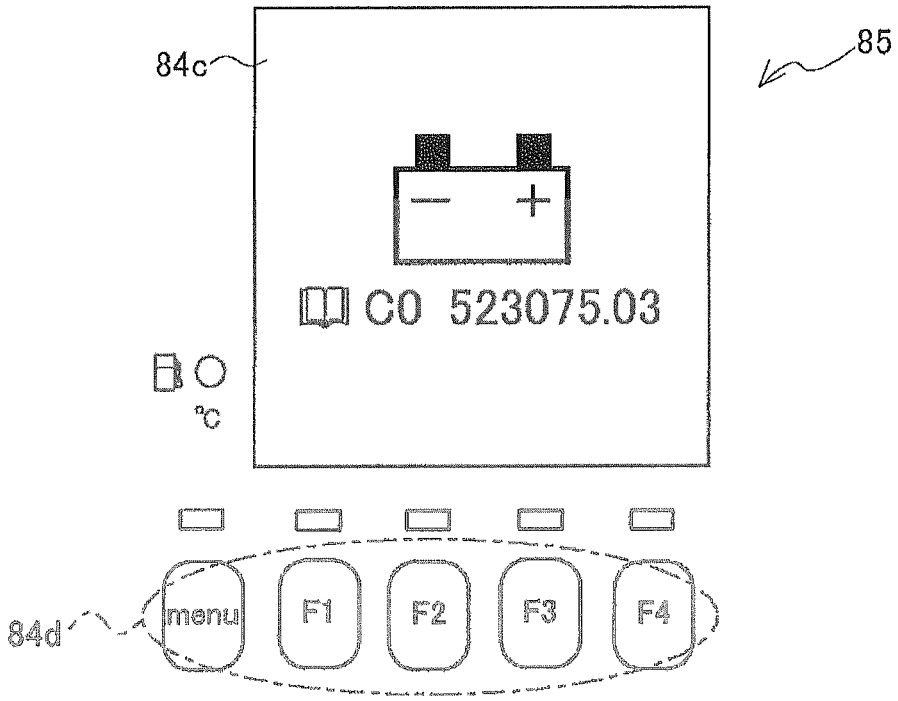
FIG. 5 is a diagram illustrating a warning and error screen, out of screens to be displayed on the display apparatus according to the first embodiment of the present invention.
Figure 6:
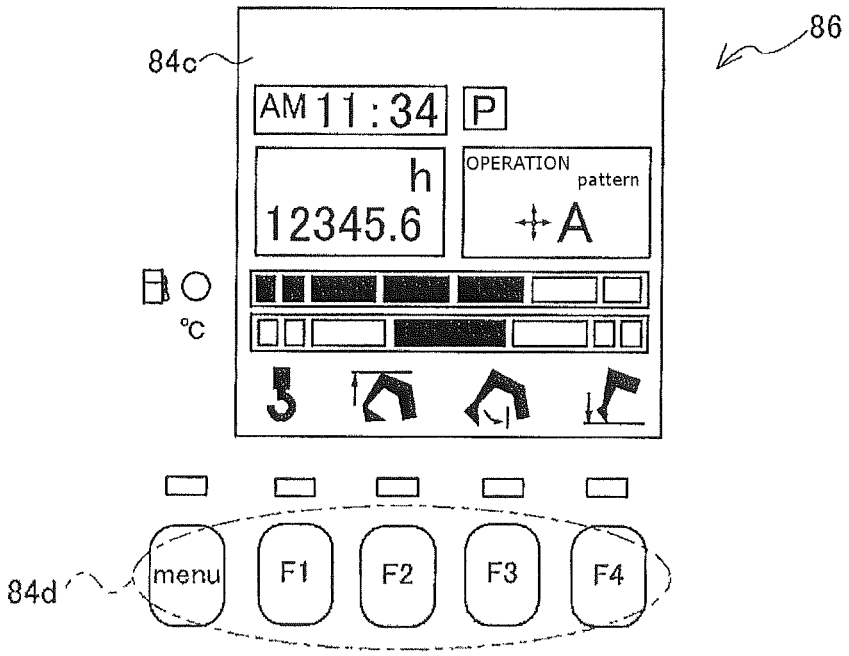
FIG. 6A is a diagram illustrating an excavation mode screen, out of screens to be displayed on the display apparatus according to the first embodiment of the present invention.
FIG. 6B is a diagram illustrating a menu screen, out of screens to be displayed on the display apparatus according to the first embodiment of the present invention.
Figure 6:
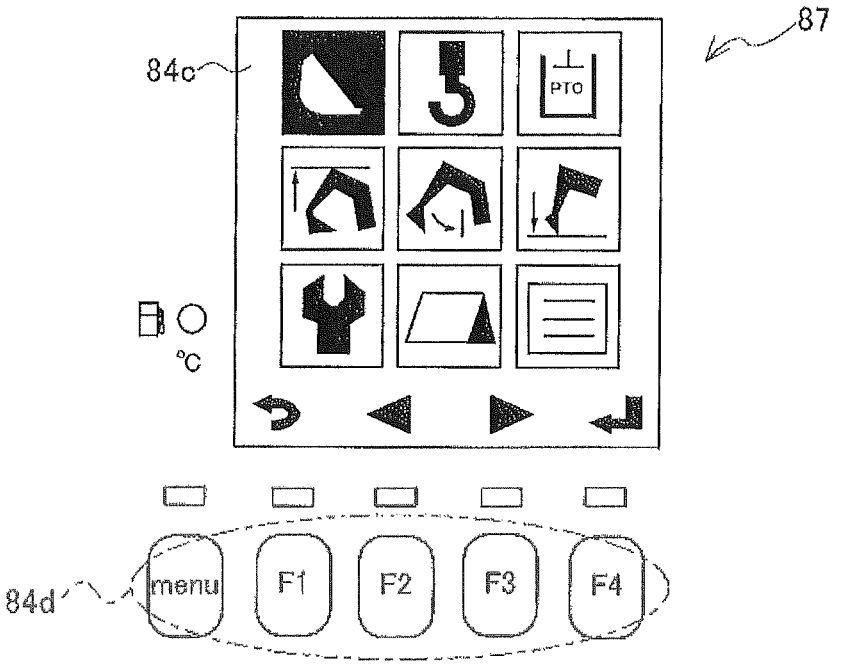

When the engine 9 starts, and the display control part 84*e* obtains the control signal of a warning and error to be displayed from the main controller 16, as is illustrated in FIG. 5, a warning and error screen 85 made up of corresponding pages of a manual and a predetermined figure is displayed on the image display part 84*c* based on the control signal.

As is illustrated in FIG. 6A, after the warning and error screen 85 is displayed, the display control part 84*e* displays an excavation mode screen 86, which is displayed at the excavating operation, on the image display part 84*c*. On the excavation mode screen 86, information on time, operating time, operating patterns, the fuel residual quantity F1, and the coolant temperature T is displayed. When the warning error occurs during the display of the excavation mode screen, the warning and error screen 85 is displayed on the image display part 84*c*.

When the display control part 84*e* obtains the input signal to be inputted through the operation of a menu button in the image screen operating part 84*d*, as is illustrated in FIG. 6B, the display control part 84*e* displays a menu screen 87 on the image display part 84*c*. On the menu screen 87, a plurality of mode selection buttons are displayed. The menu screen 87 is constituted to be switchable to a corresponding mode screen from the menu screen 87 based on the mode selection button to be selected.

Figure 7:
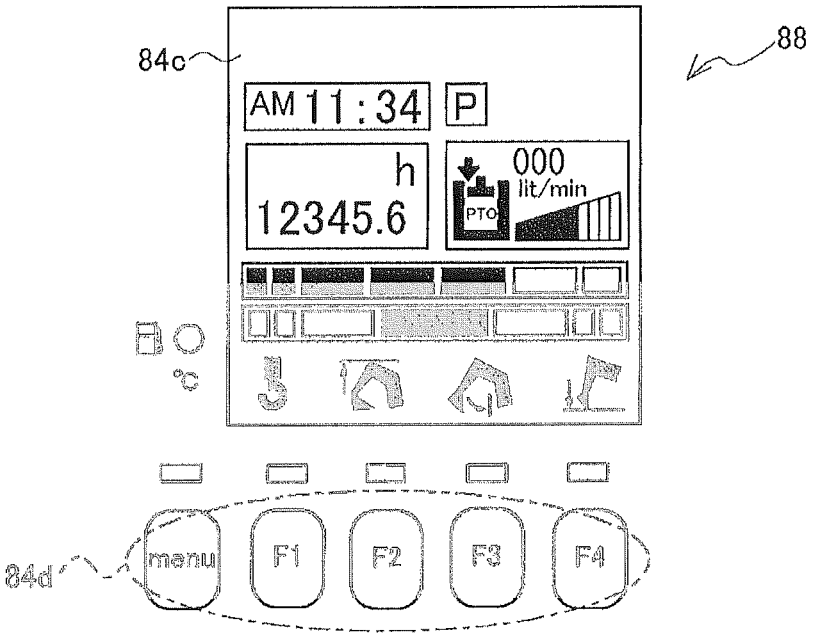
FIG. 7A is a diagram illustrating an attachment screen, out of screens to be displayed on the display apparatus according to the first embodiment of the present invention.
FIG. 7B is a diagram illustrating the attachment display screen, out of screens to be displayed on the display apparatus according to the first embodiment of the present invention.
Figure 7:
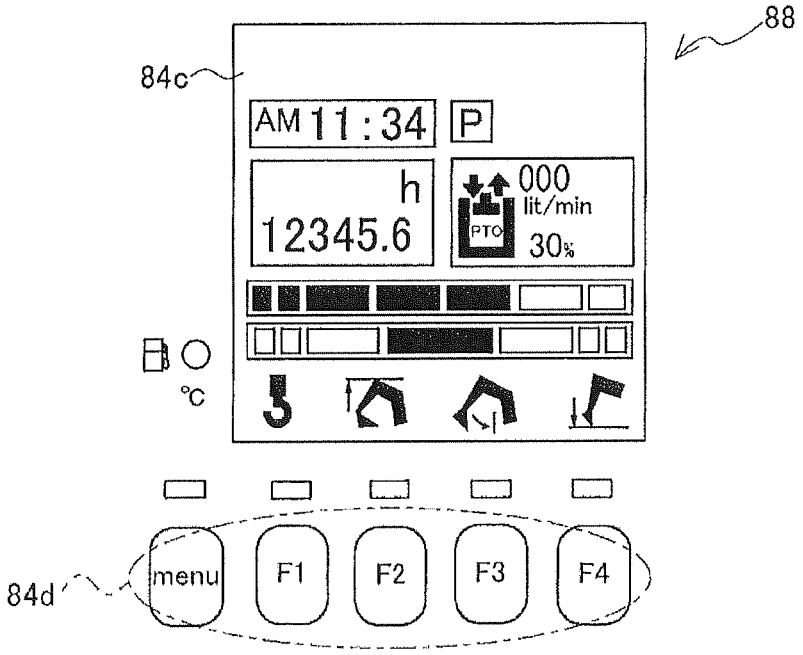

Next, an attachment display screen 88 will be described referring to FIG. 7.

When the mode selection button of the attachment mode is selected on the menu screen 87, a screen (hereinafter referred to as "attachment display screen 88") is displayed that represents the maximum flow rate Qmax of the hydraulic oil, and the present flow rate q of the hydraulic oil, and the status information on the switching valve 51 (information on whether the attachment hydraulic actuator 15 is of the single acting type or of the double acting type).

On the attachment display screen 88, the display control part 84*e* displays the maximum flow rate Qmax, the ratio of the present flow rate q to the maximum flow rate Qmax, and the information on whether the attachment hydraulic actuator 15 is of the single acting type or of the double acting type, in a single frame. In the embodiment of the present invention, the information is displayed in the middle of the screen on the right side.

As is illustrated in FIG. 7A, the display control part 84*e* displays the maximum flow rate Qmax display in numerical values and displays the ratio of the present flow rate q to the maximum flow rate Qmax with a figure (graph). Herein, it is constituted such that the ratio of the present flow rate q to the maximum flow rate Qmax is displayed by ten pieces of squares of a bar graph to be equally divided, and one piece of square is lighted as the ratio increases by 10%. The numerical values of the maximum flow rate Qmax and the figure representing the ratio of the present flow rate q to the maximum flow rate Qmax are simultaneously displayed. Based on this constitution, the maximum flow rate Qmax of the hydraulic oil and the flow rate q of the hydraulic oil that actually flows can simultaneously be verified. It is noted that the display regarding the maximum flow rate Qmax of the hydraulic oil and the flow rate q of the hydraulic oil that actually flows is not limited to the bar graph, but can be displayed by a pie chart and the like. Also, the number of squares of the bar graph to be equally divided is not limited to ten.

Also, as is illustrated in FIG. 7B, the display control part 84*e* can display the maximum flow rate Qmax and the ratio of the present flow rate q to the maximum flow rate Qmax in numerical values. Herein, the ratio of the present flow rate q to the maximum flow rate Qmax is displayed in percentages. The numerical values representing the maximum flow rate Qmax and the ratio of the present flow rate q to the maximum flow rate Qmax are simultaneously displayed. Based on this constitution, the maximum flow rate Qmax of the hydraulic oil and the flow rate q of the hydraulic oil that actually flows can simultaneously be verified.

Also, the display control part 84*e* displays information on whether the attachment hydraulic actuator 15 is of the single acting type or of the double acting type with figures. The information on whether the attachment hydraulic actuator 15 is of the single acting type or of the double acting type is displayed by the illustration of the attachment hydraulic actuator 15 and two arrows displayed above the illustration. When the attachment hydraulic actuator 15 is of the single acting type, as is illustrated in FIG. 7A, one piece of arrow pointed downwardly is displayed. When the attachment hydraulic actuator 15 is of the double acting type, as is illustrated in FIG. 7B, arrows pointed upwardly and downwardly are displayed. For example, when the attachment is the bucket 12, and the attachment hydraulic actuator 15 is the bucket cylinder 15A of the double acting type, the arrows pointed upwardly and downwardly are displayed. Based on this constitution, whether the attachment hydraulic actuator 15 is of the single acting type or of the double acting type can be verified.

Also, the display and non-display, regarding the numerical values of the maximum flow rate Qmax to be displayed, the figure representing the ratio of the present flow rate q to the maximum flow rate Qmax, and the figure representing the information on whether the attachment hydraulic actuator 15 is of the single acting type or of the double acting type, can be selected by the operating button. When the display or non-display is selected by the operating button, the control part displays or does not display the numerical values of the maximum flow rate Qmax, the figure representing the ratio of the present flow rate q to the maximum flow rate Qmax, and the figure representing the information on whether the attachment hydraulic actuator 15 is of the single acting type or of the double acting type, which are displayed on the display portion.

As is described above, the backhoe 1 includes the working apparatus 4 in which the attachment operated by the hydraulic actuator is attachably mounted, the flow rate limitation setting means 55 configured to set the maximum flow rate of hydraulic oil that is supplied and discharged with respect to the hydraulic actuator, the engine revolution sensor 52, the cam plate angle sensor 53, and the valve opening degree sensor 54, which are configured to measure the present flow rate of the hydraulic oil, the switching valve 51 configured to switch between the single acting type and the double acting type in accordance with a type of the hydraulic actuator, the display apparatus 84 configured to display the flow rate of the hydraulic oil and whether the hydraulic actuator is made up of any of the single acting type and the double acting type, the main controller 16 configured to connect the flow rate limitation setting means 55, the engine revolution sensor 52, the cam plate angle sensor 53, the valve opening degree sensor 54, the switching valve 51, and the display apparatus 84, wherein the maximum flow rate Qmax and the present flow rate q, which are set by the flow rate limitation setting means 55, are simultaneously displayed on the display apparatus 84.

Based on this constitution, the maximum flow rate Qmax of the hydraulic oil and the flow rate q of the hydraulic oil that actually flows can simultaneously be verified. Also, whether the attachment is of the single acting type or of the double acting type can be verified.

Also, with respect to the display apparatus 84, the display or non-display of the maximum flow rate Qmax and the display or non-display of the present flow rate q can be selectable.

Based on this constitution, the operator can select and verify the information that the operator needs to know, out of the maximum flow rate Qmax and the present flow rate q.

Also, the display of the maximum flow rate Qmax and display of the present flow rate q are displayed in numerical values in the display apparatus 84.

Based on this constitution, the maximum flow rate Qmax of the hydraulic oil and the flow rate q of the hydraulic oil that actually flows can be verified at one time.

Also, the display of the maximum flow rate Qmax and display of the present flow rate q are displayed with figures in the display apparatus 84.

Based on this constitution, the maximum flow rate Qmax of the hydraulic oil and the flow rate q of the hydraulic oil that actually flows can be verified at one time.

INDUSTRIAL APPLICABILITY

The present invention can be utilized for a working vehicle including a plurality of hydraulic actuators.

DESCRIPTION OF THE REFERENCE NUMERAL

7 Rotation motor (hydraulic actuator)
9 Engine
13 Boom cylinder (hydraulic actuator)
14 Arm cylinder (hydraulic actuator)
15 Attachment hydraulic actuator
15A Bucket cylinder
81 Operating seat
84*c* Image display part
84*e* Control part

The invention claimed is:

1. A working vehicle comprising:

a working apparatus in which an attachment operated by a hydraulic actuator is attachably mounted;

a flow rate limitation setting means structured to set a maximum flow rate of hydraulic oil that is supplied and discharged with respect to the hydraulic actuator;

a measuring means structured to measure a present flow rate of the hydraulic oil;

a switching setting means structured to switch between a single acting type and a double acting type in accordance with a type of the hydraulic actuator;

a display means structured to display the flow rate of the hydraulic oil and whether the hydraulic actuator is made up of any of the single acting type and the double acting type; and a main controlling apparatus structured to connect the flow rate limitation setting means, the measuring means, the switching setting means and the display means, wherein the maximum flow rate which is set by the flow rate limitation setting means and the present flow rate are simultaneously displayed on the display means;

wherein the display of the maximum flow rate and the display of the present flow rate are displayed in numerical values on the display means.

2. The working vehicle according to claim 1, wherein the display of the maximum flow rate and the display of the present flow rate are switchably displayed on the display means.

3. A working vehicle comprising:

a working apparatus in which an attachment operated by a hydraulic actuator is attachably mounted;

a flow rate limitation setting means structured to set a maximum flow rate of hydraulic oil that is supplied and discharged with respect to the hydraulic actuator;

a measuring means structured to measure a present flow rate of the hydraulic oil;

a switching setting means structured to switch between a single acting type and a double acting type in accordance with a type of the hydraulic actuator;

a display means structured to display the flow rate of the hydraulic oil and whether the hydraulic actuator is made up of any of the single acting type and the double acting type; and a main controlling apparatus structured to connect the flow rate limitation setting means, the measuring means, the switching setting means and the display means, wherein the maximum flow rate which is set by the flow rate limitation setting means and the present flow rate are simultaneously displayed on the display means;

wherein the display of the maximum flow rate and the display of the present flow rate are displayed by figures on the display means.

4. A working vehicle comprising:

a working apparatus in which an attachment operated by a hydraulic actuator is attachably mounted;

a flow rate limiter structured to set a maximum flow rate of hydraulic oil that is supplied and discharged with respect to the hydraulic actuator;

a sensor structured to measure a present flow rate of the hydraulic oil;

a switching valve structured to switch between a single acting type and a double acting type in accordance with a type of the hydraulic actuator;

a display apparatus structured to display the flow rate of the hydraulic oil and whether the hydraulic actuator is made up of any of the single acting type and the double acting type; and a main controller structured to connect the flow rate limiter, the sensor, the switching valve and the display apparatus, wherein the maximum flow rate which is set by the flow rate limiter and the present flow rate are simultaneously displayed on the display apparatus.

* * * * *